US006601863B1

(12) United States Patent
Mentessi et al.

(10) Patent No.: US 6,601,863 B1
(45) Date of Patent: Aug. 5, 2003

(54) MID-WHEEL DRIVE WHEELCHAIR WITH RIGID FRONT WHEEL ANTI-TIP STABILIZER

(75) Inventors: Roland A. Mentessi, North Royalton, OH (US); John O. Jindra, Elyria, OH (US); Jason D. Hunt, Ann Arbor, MI (US); James R. Miadock, Lorain, OH (US)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 09/347,208

(22) Filed: Jul. 2, 1999

Related U.S. Application Data

(63) Continuation-in-part of application No. 09/163,782, filed on Sep. 30, 1998, now Pat. No. 6,073,951.

(60) Provisional application No. 60/060,952, filed on Oct. 6, 1997.

(51) Int. Cl.[7] ..... C10G 25/06

(52) U.S. Cl. ..... 280/304.1; 280/250.1; 280/788; 180/907

(58) Field of Search ..... 280/304.1, 250.1, 280/788; 180/907; 297/300.1, 130

(56) References Cited

U.S. PATENT DOCUMENTS

| | | | | |
|---|---|---|---|---|
| 3,580,591 A | * | 5/1971 | Coffey et al. | 280/5.32 |
| 3,618,968 A | | 11/1971 | Greer | |
| 3,848,883 A | * | 11/1974 | Breacain | 280/5.32 |
| 3,901,337 A | * | 8/1975 | Cragg | 180/6.5 |
| 3,930,551 A | * | 1/1976 | Cragg | 180/6.5 |
| 3,952,822 A | | 4/1976 | Udden et al. | |
| 3,953,054 A | | 4/1976 | Udden et al. | |
| 3,976,152 A | | 8/1976 | Bell | |
| 4,166,631 A | * | 9/1979 | Sanaski | 280/289 X |
| 4,247,125 A | | 1/1981 | Rayment | |
| 4,360,213 A | | 11/1982 | Rudwick et al. | |
| 4,415,202 A | * | 11/1983 | Pew | 280/289 X |
| 4,431,076 A | | 2/1984 | Simpson | |
| 4,500,102 A | * | 2/1985 | Haury et al. | 280/304.1 |
| 4,513,832 A | | 4/1985 | Engman | |
| 4,614,246 A | | 9/1986 | Masse et al. | |
| 4,721,321 A | | 1/1988 | Haury et al. | |
| 4,926,777 A | | 5/1990 | Davis, Jr. | |
| 5,004,259 A | | 4/1991 | Ayers et al. | |

(List continued on next page.)

FOREIGN PATENT DOCUMENTS

| | | |
|---|---|---|
| FR | 77 24528 | 3/1979 |
| GB | 611835 | 11/1948 |
| GB | 1 503 910 | 3/1978 |
| GB | 2 265 868 | 10/1993 |
| SU | 1297-854 | 3/1987 |
| WO | 89 06117 | 7/1989 |
| WO | WO 90/0609 | 6/1990 |
| WO | WO 96/15752 | 5/1996 |
| WO | 96 15752 | 5/1996 |
| WO | WO 98/46184 | 10/1998 |
| WO | WO 99/17700 | 4/1999 |

*Primary Examiner*—Paul N. Dickson
*Assistant Examiner*—Toan C To
(74) *Attorney, Agent, or Firm*—Calfee, Halter & Griswold LLP; Nenad Pejic

(57) ABSTRACT

A mid-wheel drive wheelchair can have various suspensions for the drive wheel such as a rigid connection to the wheelchair frame or a resilient connection thereto. The wheelchair has at least one anti-tip front wheel stabilizer, which is rigidly, i.e. non-resiliently, connected to the frame and accordingly the wheelchair frame moves up and down with the anti-tip wheel upon encountering a bump, hill, etc. The height of the anti-tip wheel above the travel surface is adjustable and accordingly the wheel can be set to a specific height.

11 Claims, 14 Drawing Sheets

U.S. PATENT DOCUMENTS 5,042,607 A 8/1991 Falkenson et al.
5,156,226 A 10/1992 Boyer et al.
5,181,733 A 1/1993 Tague
5,294,141 A * 3/1994 Mentessi et al. ..... 280/250.1
5,351,774 A 10/1994 Okamoto
5,435,404 A 7/1995 Garin, III
5,564,512 A 10/1996 Scheulderman
5,669,619 A 9/1997 Kim
5,681,049 A 10/1997 Kim
5,695,021 A 12/1997 Schaffner et al.
5,727,802 A 3/1998 Garven, Jr. et al.
5,848,658 A 12/1998 Pulver
5,904,214 A 5/1999 Lin
5,944,131 A 8/1999 Schaffner et al.
5,964,473 A * 10/1999 Degonda et al. ..... 280/250.1
6,270,111 B1 * 8/2001 Hanson et al. ..... 280/650
6,290,011 B1 * 9/2001 Langaker et al. ..... 180/65.1

* cited by examiner

MID-WHEEL DRIVE WHEELCHAIR WITH RIGID FRONT WHEEL ANTI-TIP STABILIZER

CROSS REFERENCE

This patent application is a continuation-in-part of U.S. Ser. No. 09/163,782, filed Sep. 30, 1998, now U.S. Pat No. 6,073,951 entitled Articulating Seat/Chassis Interface For A Wheelchair, which in turn is a continuation application of U.S. Provisional Application No. 60/060,952, filed Oct. 6, 1997.

BACKGROUND OF THE INVENTION

1. Field of the Invention

The present invention relates to a mid-wheel drive wheelchair having a height adjustable front-wheel anti-tip stabilizer which is rigidly attached to the wheelchair frame and thus moves in unison with the frame. The present invention also relates a fixed front wheel anti-tip stabilizer, as above, in combination with a wheelchair seat articulatingly attached to a chassis of the wheelchair.

2. Background Art

Heretofore, mid-wheel drive wheelchairs have generally had a resilient front-wheel anti-tip stabilizer which was movably mounted to a frame, and/or to a motor which pivoted about a pivot point. Resilient mounted caster style anti-tip stabilizers are also known.

SUMMARY OF INVENTION

A mid-wheel drive wheelchair generally contains a frame which extends longitudinally fore and aft, a lateral frame member which generally extends perpendicular thereto, drive wheels which are rotatably mounted to the frame generally beneath the seat of the wheelchair and a pair of castor wheels located behind the drive wheels. Regardless of whether the drive wheels are resiliently connected or rigidly connected to the frame, the wheelchair has a height adjustable anti-tip wheel which is located forward of the drive wheels and rigidly attached to the frame to stabilize the wheelchair. The anti-tip front wheel is desirably utilized in combination with an articulating attachment of the wheelchair seat to the chassis of the wheelchair to provide for improved shock absorption, control, and especially stability of the wheelchair.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

According to the present invention, a mid-wheel drive wheelchair having a rigid anti-tip front wheel stabilizer can be utilized with any type of seat arrangement, such as a tilt seat, a reclined seat, a tilt seat having a constant center of gravity, an articulated seat, and the like, with any type of frame, with any type of drive wheel suspension such as a rigid suspension, a swing arm suspension, and the like. A desired type of seat arrangement will first be discussed in detail.

Figure 1:
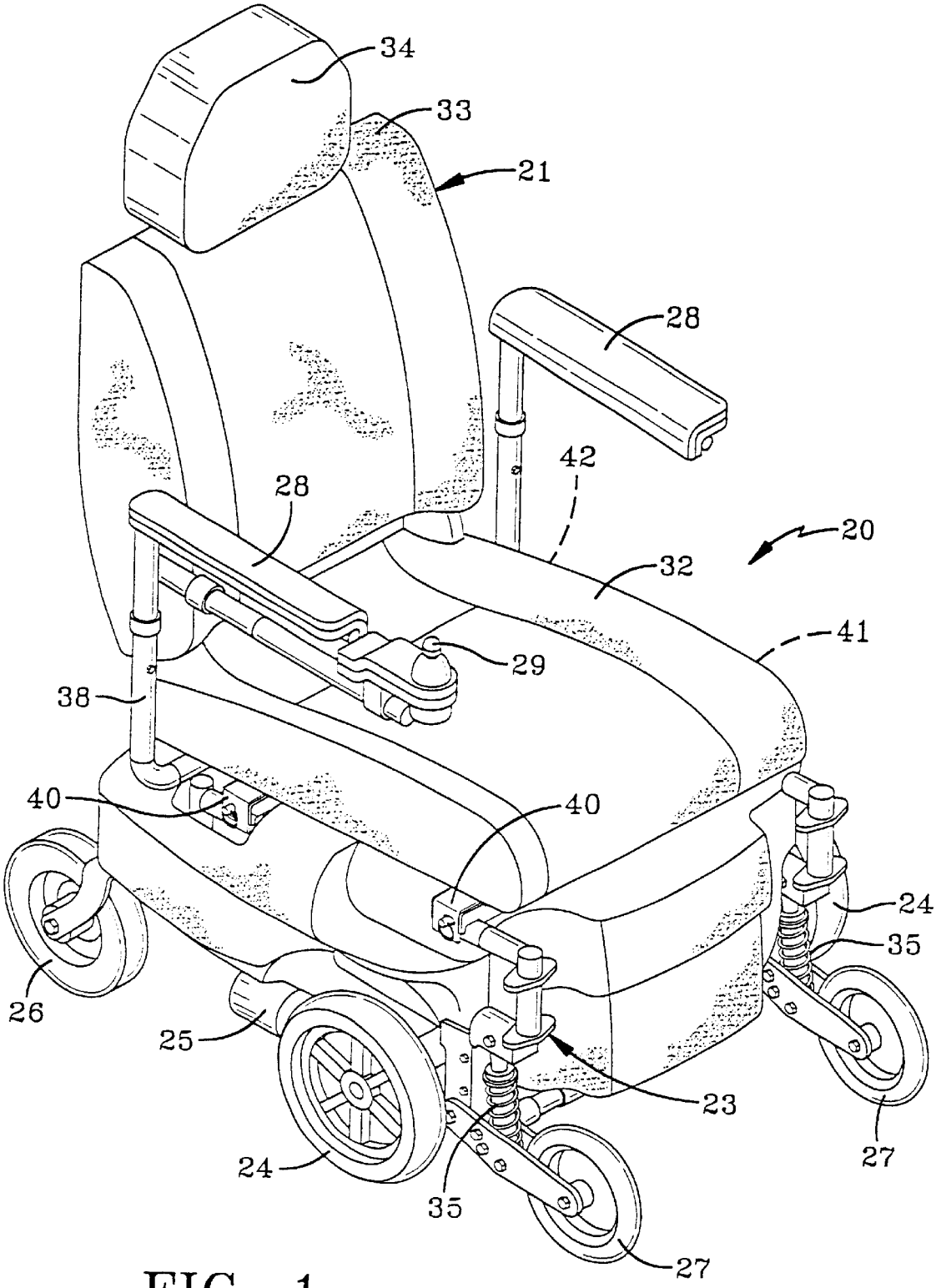
FIG. 1 is a perspective view of one type of wheelchair on which the articulating seat to chassis attachment of the present invention is incorporated.

A mid-wheel power drive wheelchair of the type on which the articulating seat to chassis interface structure of the present invention is incorporated, is indicated generally at 20 and is shown in FIG. 1. However, it is understood that the articulating seat/chassis interface of the present invention can be incorporated on any type of wheelchair, including manually driven wheelchairs and power driven wheelchairs having the drive wheels disposed other than mid or near the center of gravity of the wheelchair. Wheelchair 20 includes a rigid upholstered captain or van-type seat 21, a seat frame 22 (see FIG. 4), and a chassis 23. A pair of drive wheels 24, each of which is independently powered by a respective one of a pair of motors 25, each is mounted on chassis 23 substantially close to the center of gravity of wheelchair 20 for improved traction. However, it is apparent to those skilled in the wheelchair art that positioning of drive wheels 24 near the center of gravity of wheelchair 20 creates instability in the wheelchair and makes it more susceptible to tipping and the like. Thus, a pair of laterally spaced caster wheels 26 is mounted on the rear end of chassis 23 rearwardly of drive wheels 24, and a pair of laterally spaced stabilizer or anti-tipping wheels 27 is mounted on the front end of chassis 23 frontwardly of the drive wheels, to provide stability to the wheelchair.

Figure 2:
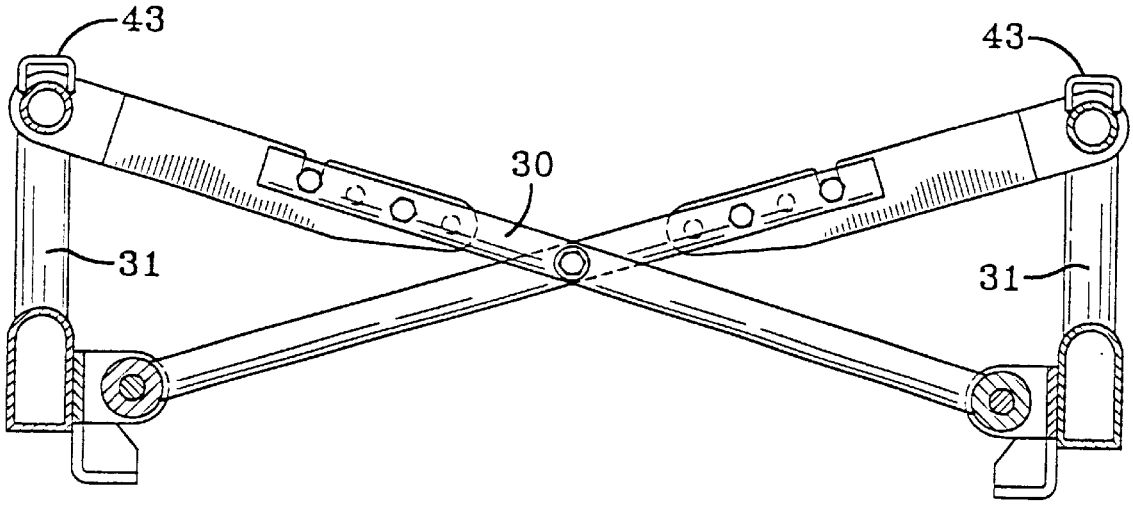
FIG. 2 is an enlarged diagrammatic front view, with portions in section and hidden parts represented by broken lines, of the cross-brace and associated structure of the wheelchair chassis of FIG. 1, shown in an open or operating position.
Figure 3:
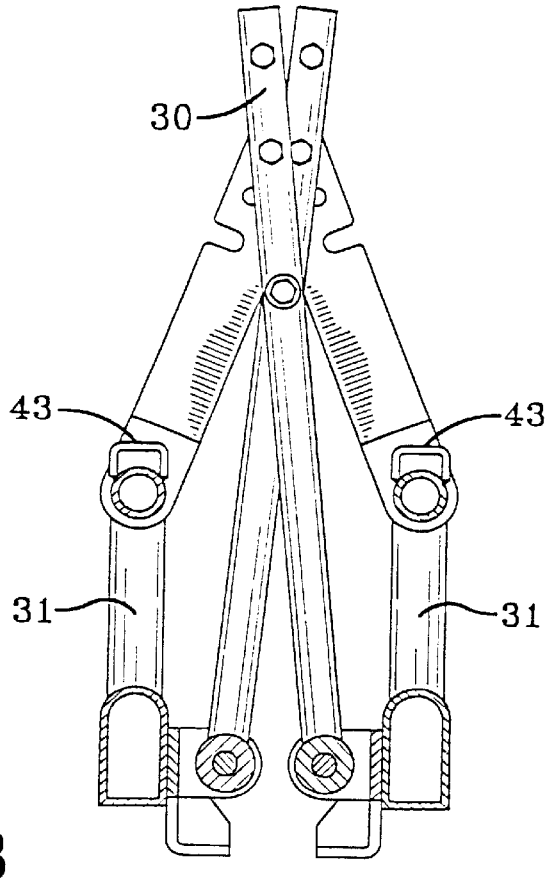
FIG. 3 is a view similar to FIG. 2, but showing the crossbrace and related structure of the chassis in a collapsed or storage/transport position.

It is understood that the articulating interface of seat frame 22 with chassis 23 has particular utility in wheelchairs having a chassis, which includes a crossbrace assembly 30 (FIGS. 2 and 3). Crossbrace 30 is movable between an operational or open position, as shown in FIG. 2, wherein seat 21 and seat frame 22 can be mounted thereon, and a collapsed or storage/transport position, as shown in FIG. 3, after removal of the seat and the seat frame from chassis 23. The resulting collapsibility of chassis 23 makes it convenient for the user of wheelchair 20 to transport the wheelchair to different locations such as in a car, van or truck, or to store the wheelchair. Another advantage of a crossbrace-type chassis 23 when used in conjunction with a flexible sling-type seat (not shown) of the type well known to the art and to the literature, is that a pair of sideframes 31 (FIGS. 2, 3 and 6) of chassis 23 each is able to independently move or articulate when a depression, bump or other irregularity is encountered by usually one of wheels 24, 26, and still maintain all of the wheels in continuous contact with the surface on which wheelchair 20 is traveling. It is understood that anti-tipping wheels 27 each is disposed adjacent to but spaced from the travel surface. Each wheel 27 is biased in the direction of the travel surface by a spring 35 (FIGS. 1 and 8), and can assist in stabilizing wheelchair 20 when the wheelchair encounters certain irregularities in the travel surface or when the wheelchair travels down inclines or comes to an abrupt stop. Thus, such articulation enables wheelchair 20 to absorb shocks, which insulates the occupant of the wheelchair from such shocks, and also maintains the steering control and stability of the entire wheelchair. However, sling-type seats are relatively uncomfortable and have a clinical appearance, and thus many wheelchair users prefer the more comfortable and aesthetically pleasing rigid upholstered van-type seat 21, which includes a seat bottom 32, a seat back 33 and a backrest extension 34 which is usually offered as an option. Van-type seats, however, interfere with articulation of cross-brace type chassis 23.

Turning now to seat frame 22 (FIG. 4), the seat frame includes a pair of longitudinally extending, spaced-apart parallel rails 36. The front ends of rails 36 are interconnected by a transversely extending rail 37, and the rear ends of the rails are interconnected by a transversely extending U-shaped member 38, the upwardly extending portions of which serve as mounts for a pair of arm rests 28 and a joystick control 29 (FIG. 1). Seat belt straps 39A and 39B are each attached to a rear end of a respective one of longitudinal rails 36 and are used to restrain the occupant in wheelchair 20 during its operation.

Figure 4:
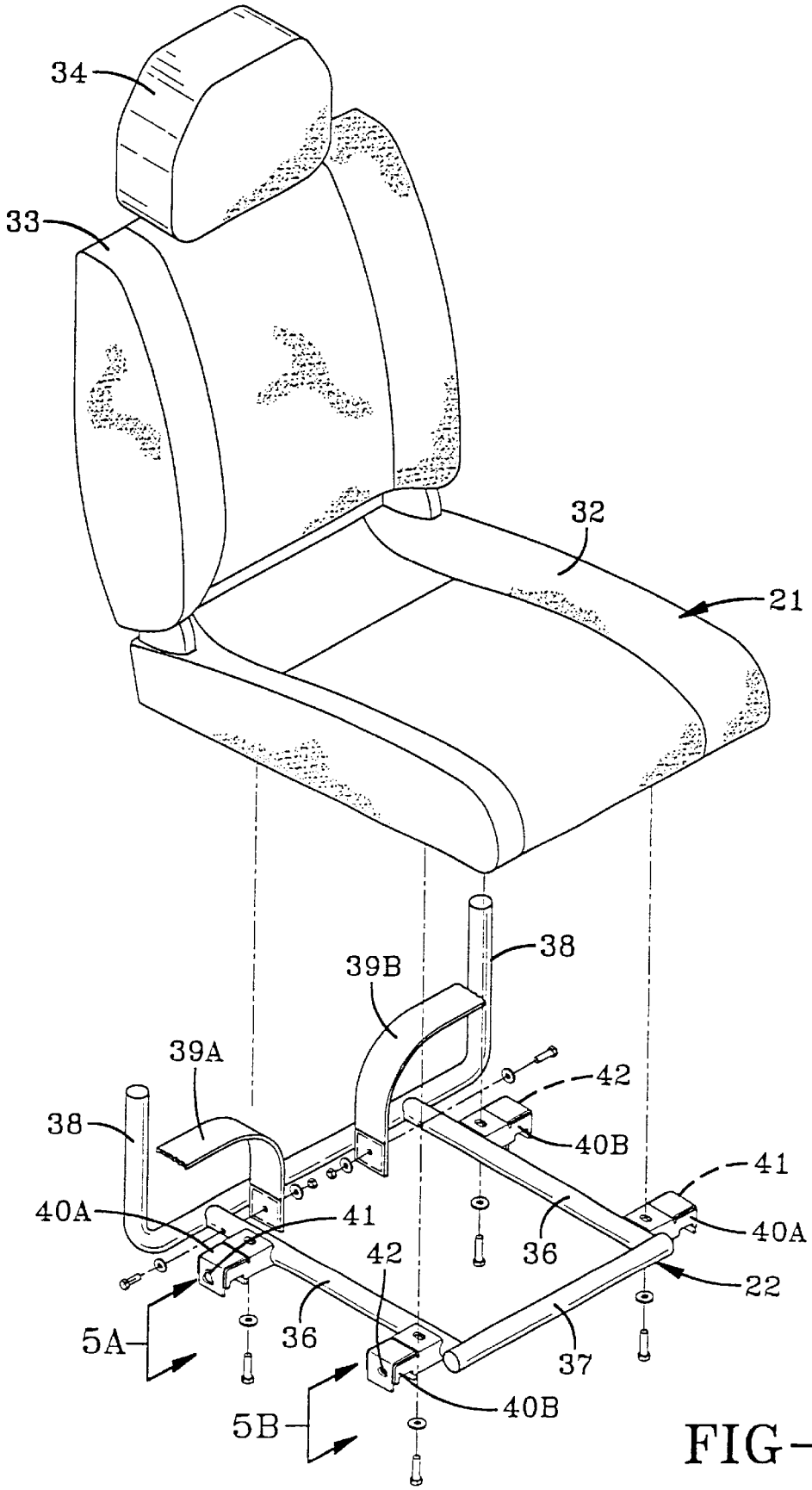
FIG. 4 is an exploded perspective view of the van seat and the seat frame of the wheelchair of FIG. 1.
Figure 5A:
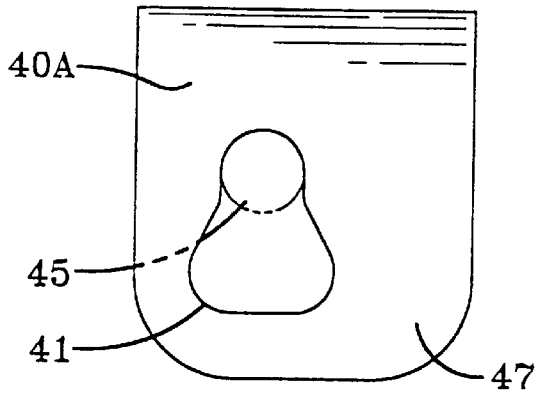
FIG. 5A is an enlarged elevational side view of one of the rear clevis assemblies of the seat frame, with a pin represented by broken lines, taken along line 5A of FIG. 4.
Figure 7:
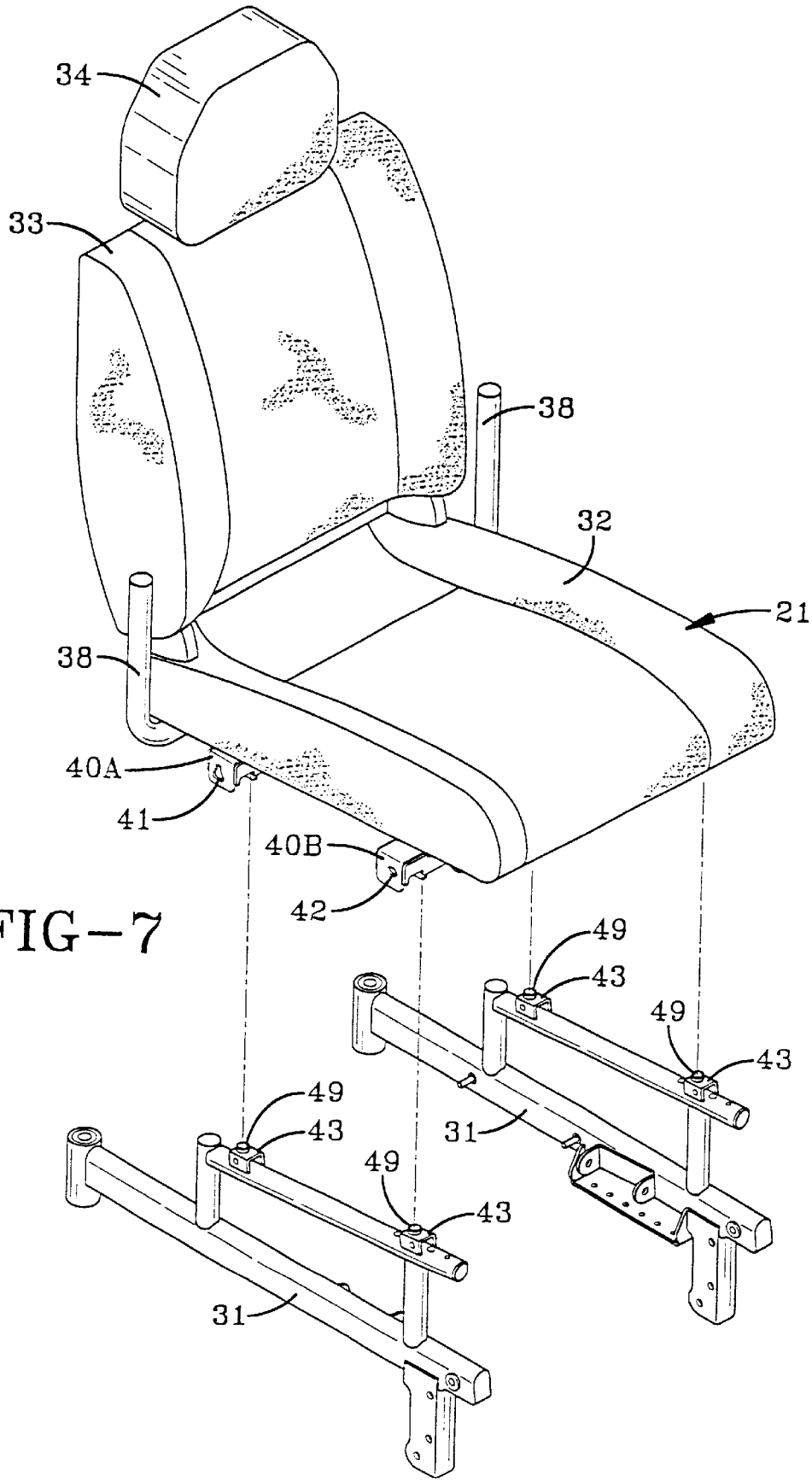
FIG. 7 is an exploded perspective view of the van seat and it's associated seat frame, and the sideframes of the wheelchair chassis.
Figure 7A:
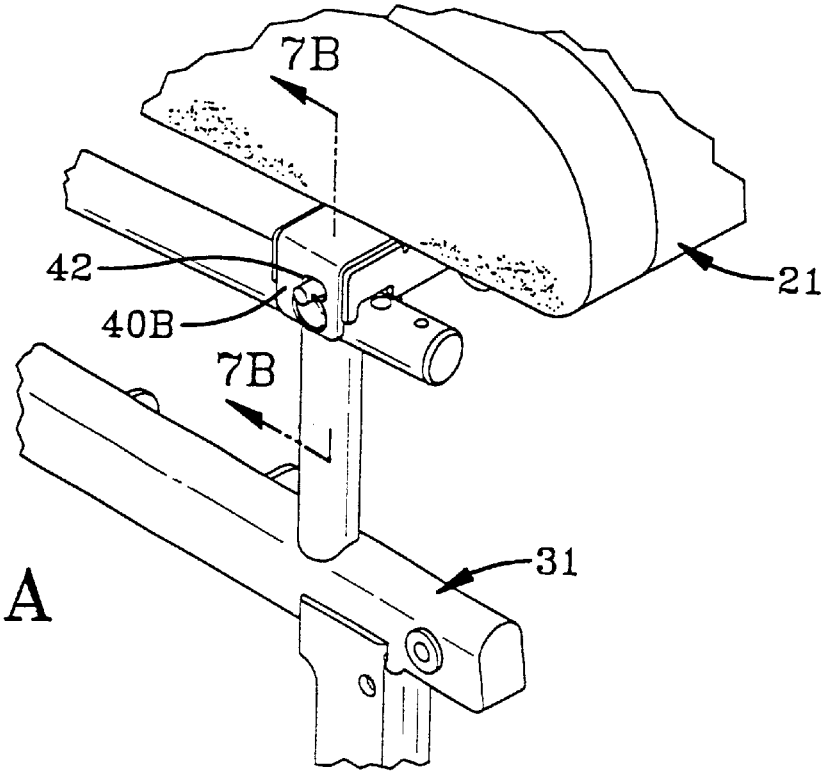
FIG. 7A is a fragmentary perspective view of one of the front corners of the van seat, seat frame and wheelchair chassis sideframes of FIG. 7, shown assembled.
Figure 7B:
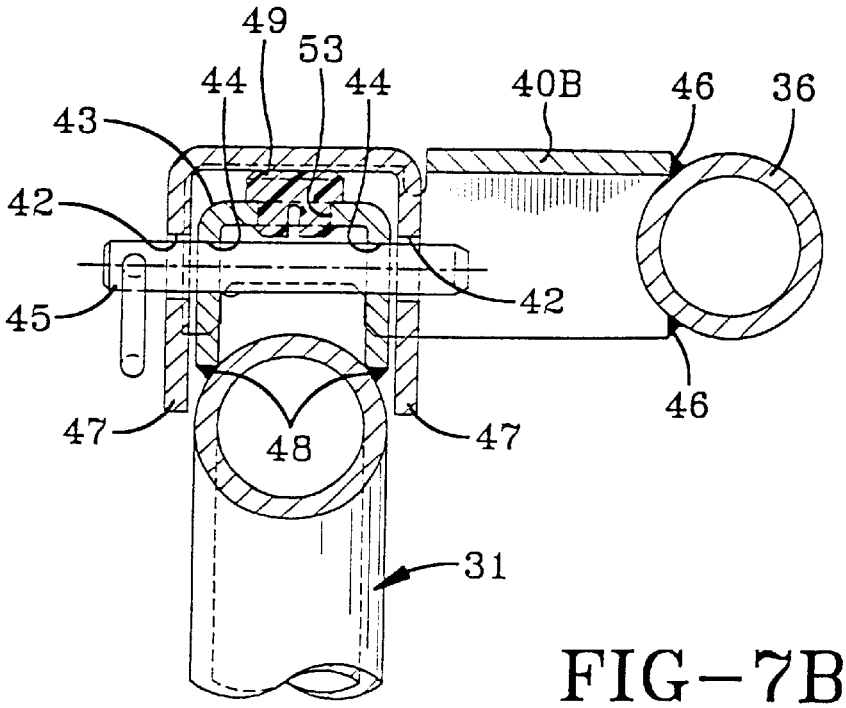
FIG. 7B is a sectional view taken along lines 7B—7B of FIG. 7A, with hidden parts represented by broken lines, particularly showing the manner in which the van seat is attached to the wheelchair chassis at each of its four corners.

In accordance with one of the key features of the present invention, a clevis assembly 40 is attached by any suitable means such as weld 46, to each one of the ends of longitudinal rails 36 adjacent to each corner of seat frame 22 as best shown in FIGS. 4 and 7B. Clevis assemblies 40 each include a pair of spaced-apart, vertically extending walls 47. One pair of clevis assemblies 40A is disposed at diagonally opposed front and rear corners of seat frame 22. Each pair of walls 47 of each clevis assembly 40A is formed with an aligned pair of generally pear-shaped openings 41 (FIG. 5A). Another pair of clevis assemblies 40B is disposed at the other diagonally opposed front and rear corners of seat frame 22, and each pair of walls 47 of each clevis assembly 40B is formed with an aligned pair of generally horizontally disposed elliptical-shaped openings 42 (FIGS. 58 and 7B). The main purpose of elliptical openings 42 is to provide for manufacturing tolerances since individual components of wheelchair 20 typically are separately manufactured and then subsequently assembled, and the play provided by openings 42 in the longitudinally extending or front-rear direction aids assembly of seat frame 22 to chassis 23. The purpose of pear-shaped openings 41 will be set forth in detail hereinbelow.

Figure 6:
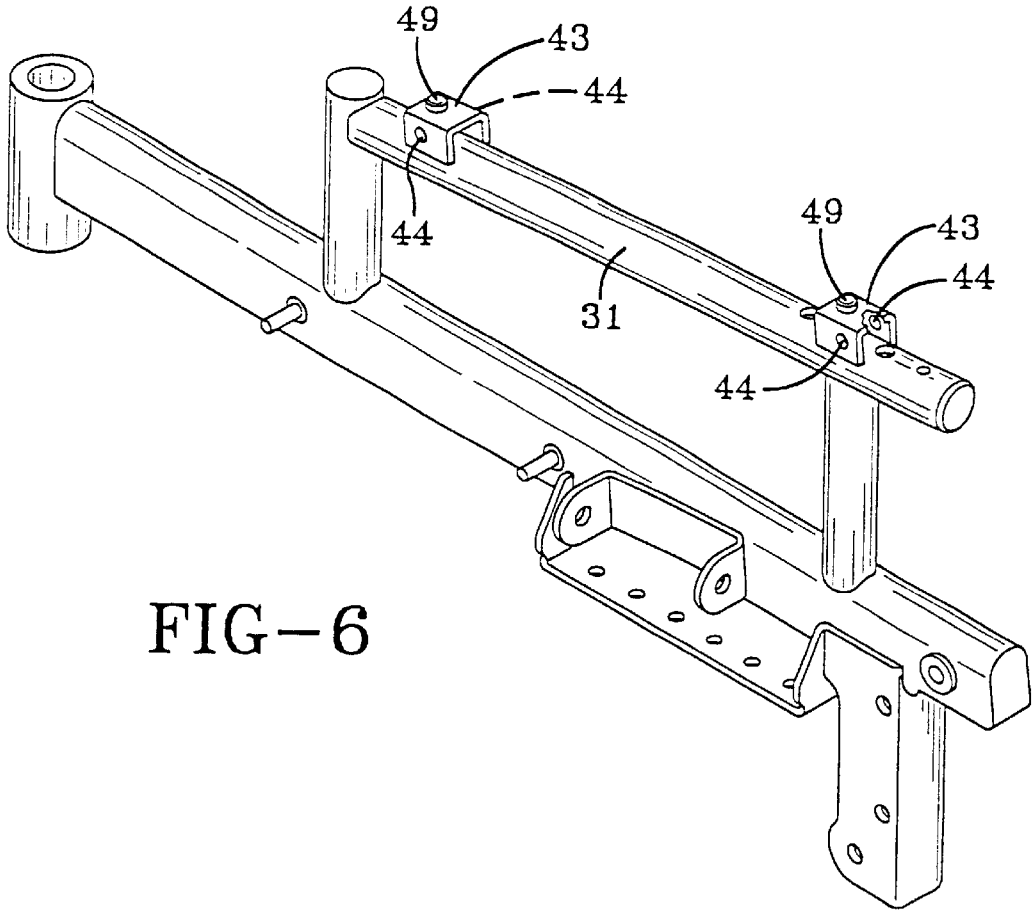
FIG. 6 is an enlarged perspective view, with a portion broken away, of one of the sideframes of the wheelchair chassis.

It can be appreciated that once van seat 21 is attached to seat frame 22 in a usual manner as illustrated in FIGS. 4 and 7, then the entire seat/seat frame assembly is removably mounted on the pair of spaced-apart sideframes 31 of chassis 23 (FIGS. 6 and 7). A pair of longitudinally spaced inverted U-shaped mounting brackets 43 is attached to each chassis sideframe 31 by welds 48. When van seat frame 22 is positioned above sideframes 31 in the manner shown in FIG. 7 by aligning each clevis assembly 40 with a respective one of U-shaped brackets 43, seat 21 then can be attached to chassis 23 as shown in FIGS. 1, 7A, 7B, and 8. More particularly, each pair of aligned openings 41, 42 formed in clevis assemblies 40A, 40B, respectively, is aligned with a respective pair of aligned circular openings 44 formed in vertical portions of each U-shaped bracket 43. A quick release pin 45 of a type well known to those skilled in the art is passed through each set of aligned pairs of openings 41, 44 and 42, 44 to secure van seat frame 22 to chassis sideframes 31. As best shown in FIGS. 7 and 7B, a plug 49 is snap fitted in an opening 53 formed in the horizontal top wall of each mounting bracket 43. Plug 49 preferably is formed of nylon, but can be formed of any other durable, low friction material such as rubber, high-density polyethylene, or the like. Plug 49 prevents clevis 40 from resting solely on pin 45 and in turn thus prevents the pin from bearing the full load of seat frame 22, van seat 21 and the occupant of the wheelchair, thereby extending the life of the pin.

Figure 8:
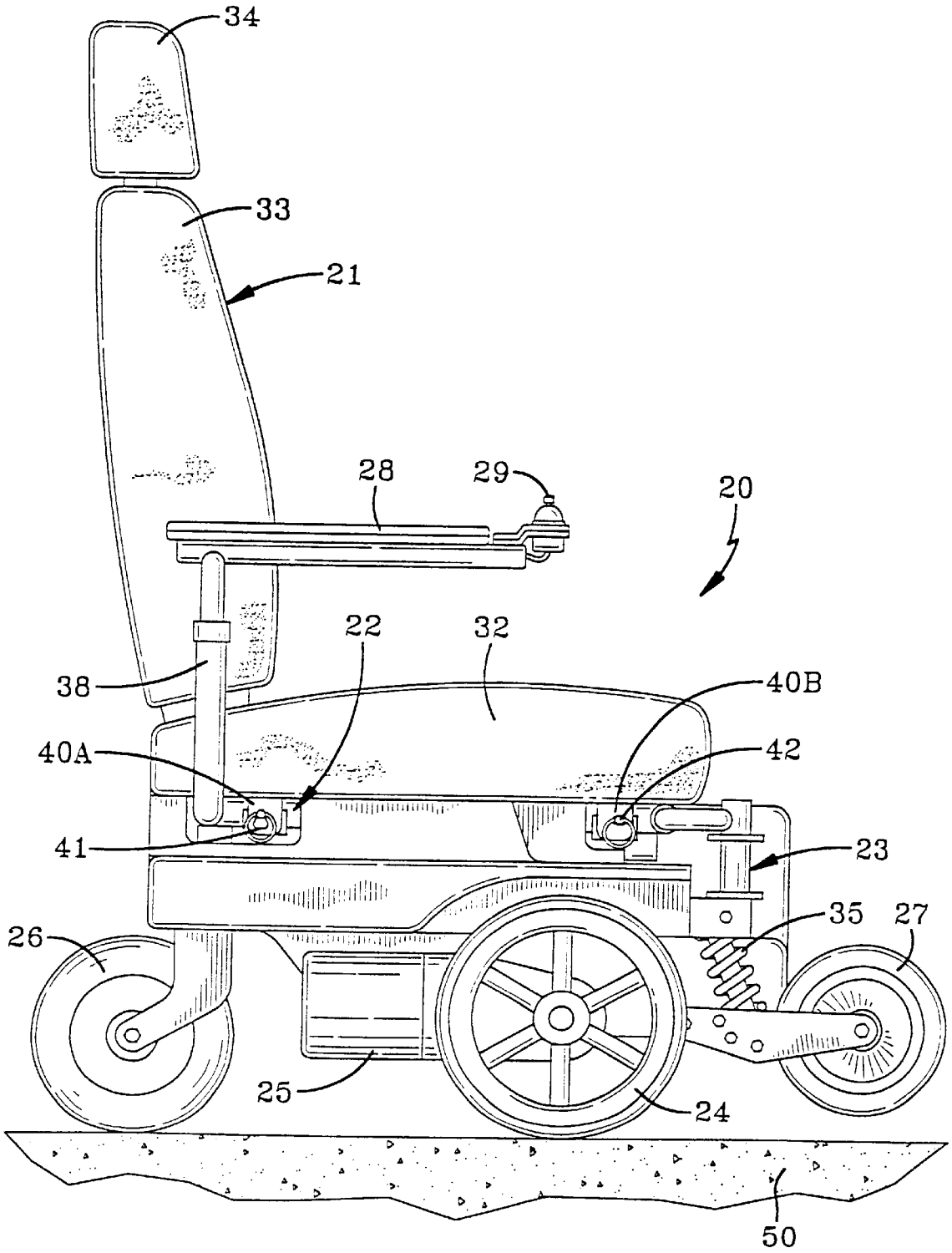
FIG. 8 is an elevational right-hand side view of the van seat and its associated seat frame mounted on the sideframes of the wheelchair chassis.

In accordance with an important feature of the present invention, pear-shaped openings 41 formed in clevis assemblies 40A allow articulation of chassis 23 and seat frame 22 relative to one another when a bump, depression or other irregularity is encountered, typically by certain ones of wheels 24, 26 of wheelchair 20. More specifically, pear-shaped openings 41, which each generally taper from a narrower width at its upper end to a wider width at its lower end, each enables its respective corner of wheelchair chassis 23 to independently move downwardly, at different times, a distance X away from seat frame 22 when bumps 52, depressions 51 or other irregularities in the wheelchair travel surface 50 are encountered, as best shown in FIGS. 9, 9A, 10, and 10A. The chassis 23 returns to its normal operating position, as best represented in FIG. 8, when the wheelchair is traveling over a relatively smooth surface.

Figure 9:
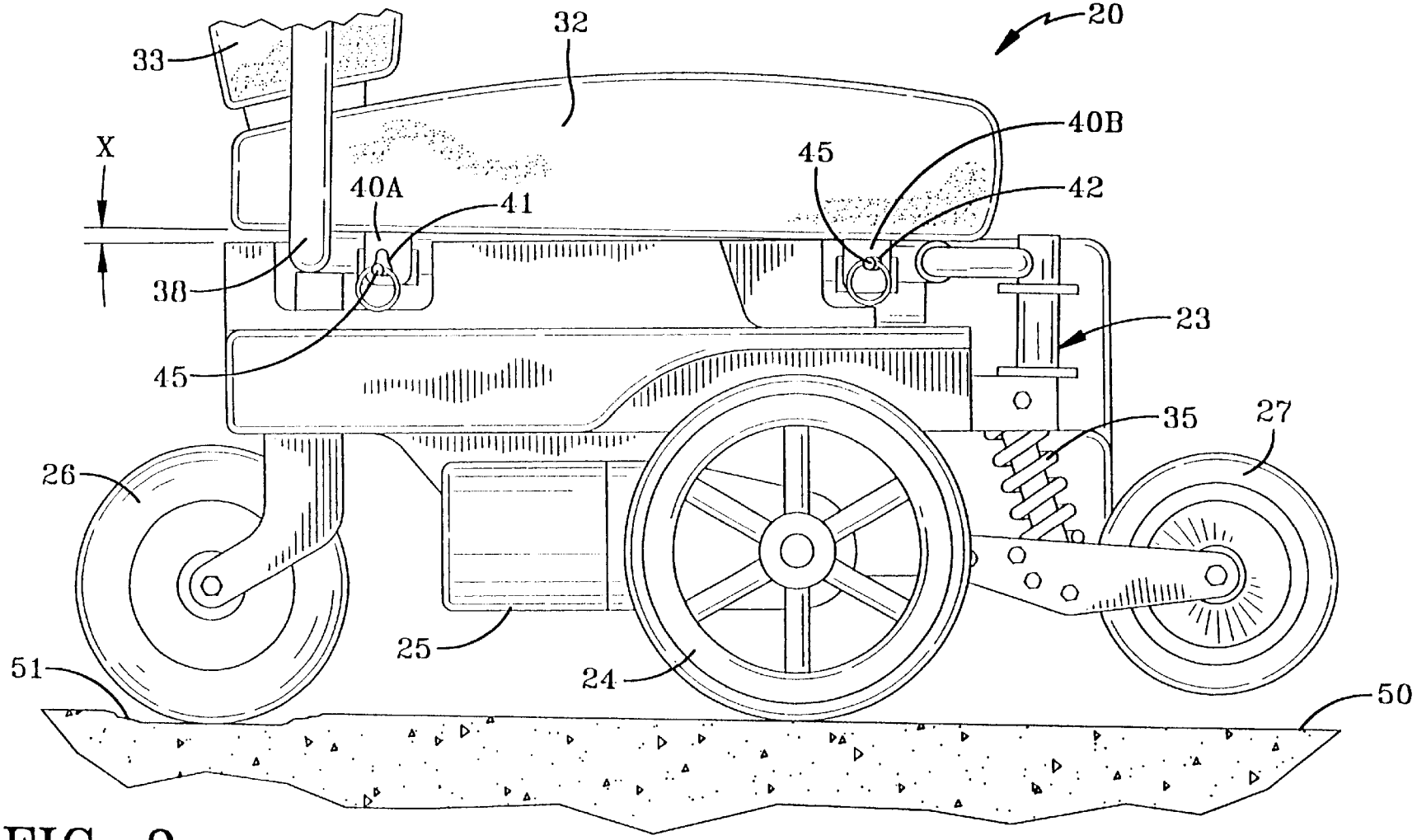
FIG. 9 is an enlarged fragmentary right-hand elevational side view showing the articulation between the chassis and van seat of the wheelchair when a depression in the travel surface of the wheelchair is encountered by one of the caster wheels.
Figure 9A:
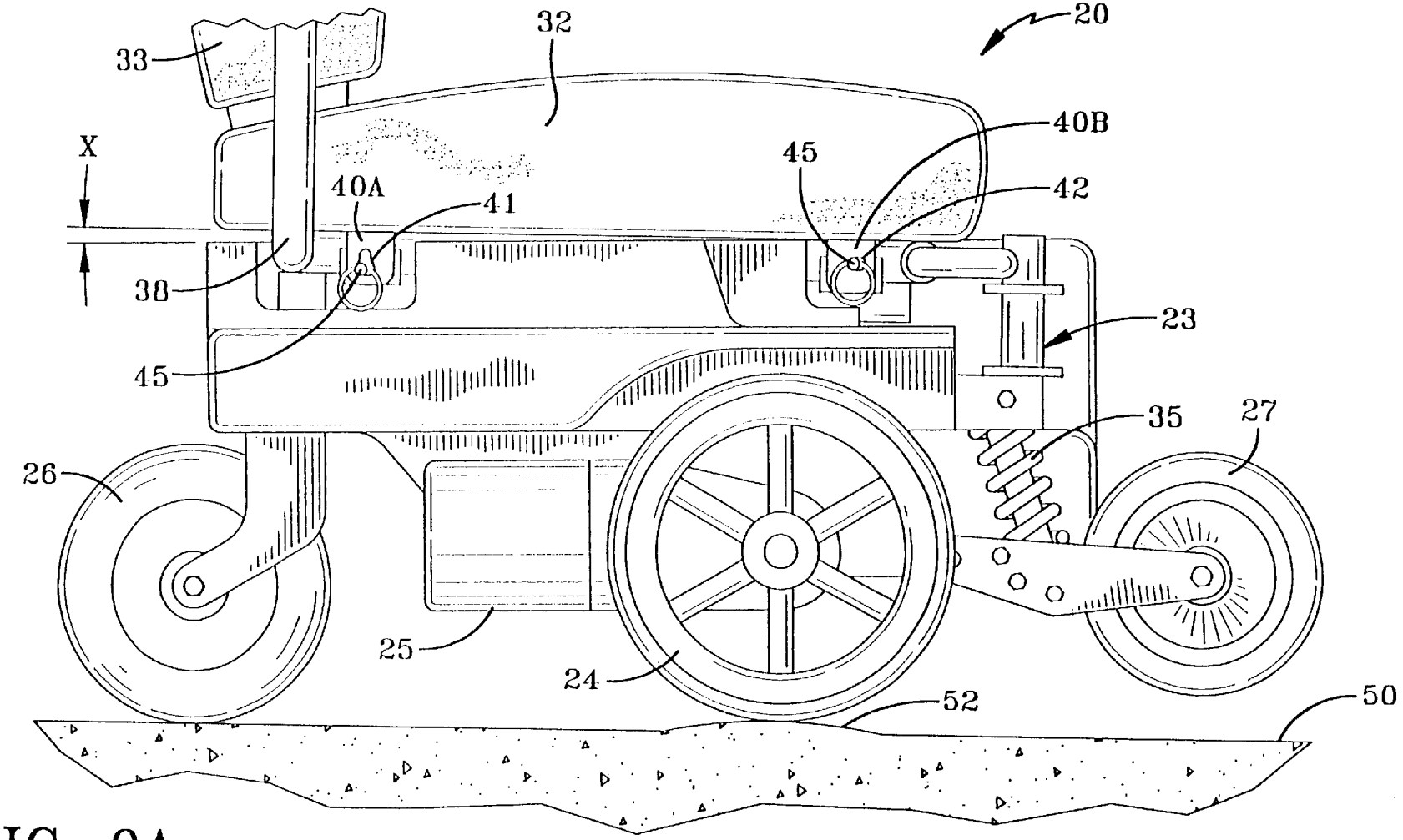
FIG. 9A is a view similar to FIG. 9, but showing the articulation between the chassis and van seat when a bump in the travel surface of the wheelchair is encountered by one of the drive wheels.
Figure 10:
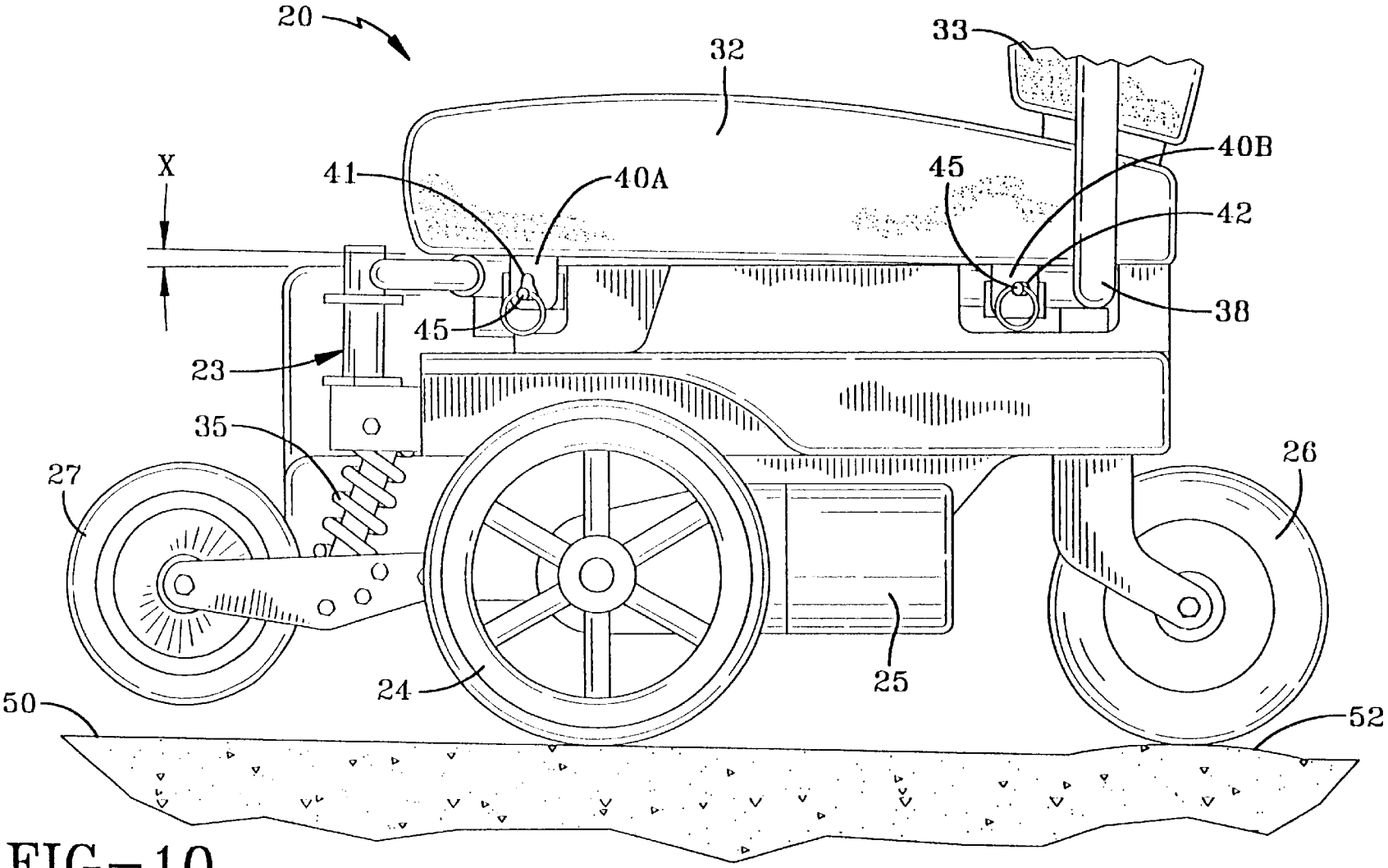
FIG. 10 is an enlarged fragmentary left-hand elevational side view showing the articulation between the chassis and van seat of the wheelchair when a bump in the travel surface of the wheelchair is encountered by one of the caster wheels.
Figure 10A:
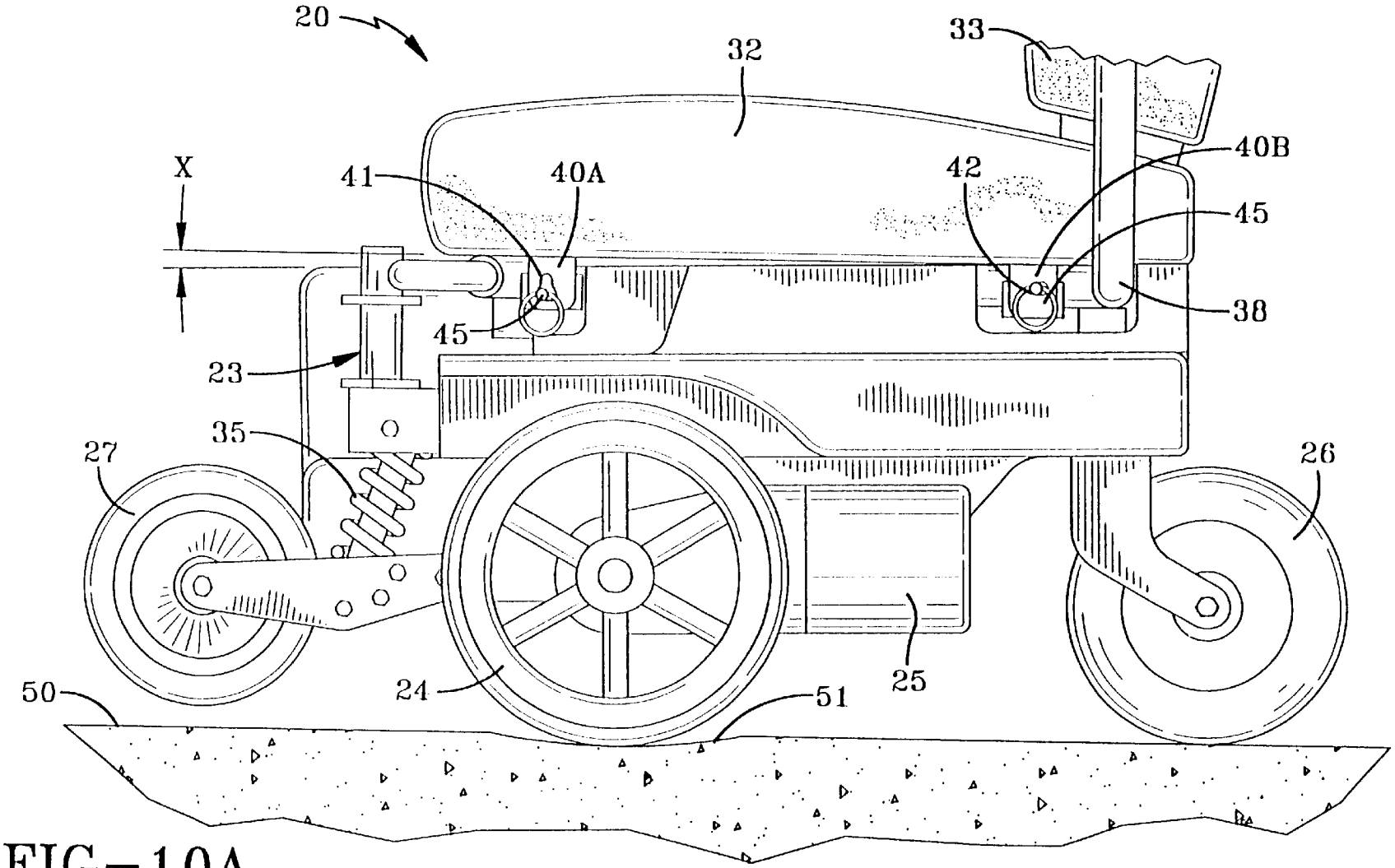
FIG. 10A is a view similar to FIG. 10, but showing the articulation between the chassis and the van seat when a depression in the travel surface of the wheelchair is encountered by one of the drive wheels.

It should be understood that the articulating seat/chassis interface for a wheelchair of the present invention only articulates under certain circumstances. More particularly, there are four instances when articulation occurs. Namely, and as.best shown in FIG. 9, when the right-hand caster wheel 26 encounters a depression 51, the right rear corner of chassis 23 follows the caster wheel Into the depression a distance X, and left-hand caster wheel 26 and drive wheels 24 remain in contact with travel surface 50, thereby providing the benefits of articulation. As shown in FIG. 9A, articulation also occurs when right-hand drive wheel 24 encounters a bump 52, and the right rear corner of chassis 23 again moves away from seat frame 22 a distance X. Viewing FIG. 1 0, when left-hand caster wheel 26 encounters a bump 52, the left front corner of chassis 23 articulates away from seat frame 22 a distance X. Finally, when left-hand drive wheel 24 encounters depression 51, the left front corner of chassis 23 again articulates away from seat frame 22 a distance X. It is understood that the above scenarios as to the four instances when articulation occurs would be different if pear-shaped openings 41 were formed in the other diagonal clevis assemblies 40B of seat frame 22.

It should also be understood that there are certain instances in which articulation cannot occur, as follows. When either one of right-hand drive wheel 24 or left-hand caster wheel 26 encounters a depression, articulation cannot occur. Also, when either one of right-hand caster wheel 26 or left-hand drive wheel 24 encounters a bump 52, articulation cannot occur. Moreover, articulation will not occur either when both drive wheels 24 encounter a bump or a depression at the same time, or similarly, when both caster wheels 26 encounter a bump or a depression at the same time. However, there may be instances in which combinations of the above scenarios enable articulation to occur. Also, distance X is limited by the height of pear-shaped openings 41, and thus articulation may fail to prevent shocks and loss of stability and control of the wheelchair if the bumps or depressions are larger than the range of articulation X of chassis 23 from seat frame 22.

Although articulation between wheelchair chassis 23 and seat frame 22 is provided by the present invention only in certain instances, an important objective of the present invention is to provide articulation at a significant cost reduction from that of a conventional suspension assembly which provides articulation in almost every instance, but at a higher cost. Providing more instances of articulation by utilizing pear-shaped openings 41 of the present invention at all four corners of seat frame 22 would create rattle and instability in the attachment of the seat frame to chassis 23. Rattle also would be a problem if only two pear-shaped openings were placed in both clevis assemblies 40 at the front of seat frame 22, or alternatively in both rear clevis assemblies of seat frame 22, or in both clevis assemblies on either the right or the left-hand side of seat frame 22.

Figure 5B:
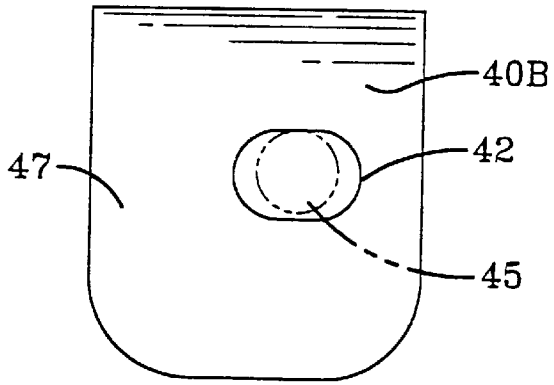
FIG. 5B is an enlarged elevational side view of one of the front clevis assemblies of the seat frame, with a pin represented by broken lines, taken along line 5B of FIG. 4.

It should also be noted, and as best shown in FIGS. 5A and 5B, that during assembly of wheelchair 20, the narrow upper portion of pear-shaped openings 41 serve as a locator for pins 45 in aligned openings 41, 42 and 44. It is understood that pins 45 can be located in the rearwardmost portion of openings 41, 42, in the central portion of the openings or in the front portion of the openings, without affecting the concept of the present invention. The wide lower portion of pear-shaped openings 41 also provides tolerance for ease of assembly and in particular during attachment of seat frame 22 to chassis side frames 31. It is further understood that openings 41 could be triangular-shaped or any other shape in which each of the openings generally taper from a narrower width at its upper end to a wider width at its lower end, again without affecting the concept of the present invention. Vertically-oriented, non-tapering openings also are contemplated by the present invention.

Thus, it can be seen that the articulating interface of seat frame 22 with chassis side frames 31 of wheelchair 20 of the present invention, and in particular clevis assemblies 40A of seat frame 22 having pear-shaped openings 41 formed therein, provides a solution in many instances to shock absorption, control and stability of wheelchairs utilizing a crossbrace-type chassis and rigid seat arrangement when a more expensive suspension assembly is undesirable. The present invention embodies a solution in a structure which is economical to manufacture and durable in use.

Accordingly, the articulating seat/chassis interface for a wheelchair of the present invention is simplified, provides an effective, safe, inexpensive, and efficient assembly which achieves all of the enumerated objectives, eliminates difficulties encountered with prior art wheelchairs, solves existing problems, and obtains new results in the art.

In the foregoing description, certain terms have been used for brevity, clarity, and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

A fixed or rigidly attached front wheel anti-tip stabilizer for a mid-wheel drive wheelchair is shown in FIGS. 11 through 15. Such anti-tip stabilizers can be utilized in association with any type of chair having a seat and back such as 16 in FIG. 3 regardless of whether it is a recline back, a tilt chair, a tilt chair having a constant center of gravity of a person seated therein, and the like. The rigid anti-tip stabilizers can also be utilized with generally any type of suspension or attachment of the chair to the wheelchair frame, with any type of wheelchair frame such as a foldable frame, a standard rigid frame, or the like, with any type of suspension between the drive wheels and the frame, with generally any type of rear wheels or castor wheels, and the like.

The above paragraph differs from the original paragraph as indicated hereinbelow:

A fixed or rigidly attached front wheel anti-tip stabilizer for a mid-wheel drive wheelchair is shown in FIGS. 11 through 15. Such anti-tip stabilizers can be utilized in association with any type of chair having a seat and back such as 16 in FIG. 3 regardless of whether it is a recline back, a tilt chair, a tilt chair having a constant center of gravity of a person seated therein, and the like. The rigid anti-tip stabilizers can also be utilized with generally any type of suspension or attachment of the chair to the wheelchair frame, with any type of wheelchair frame such as a foldable frame, a standard rigid frame, or the like, with any type of suspension between the drive wheels and the frame, with generally any type of rear wheels or castor wheels, and the like.

Figure 11:
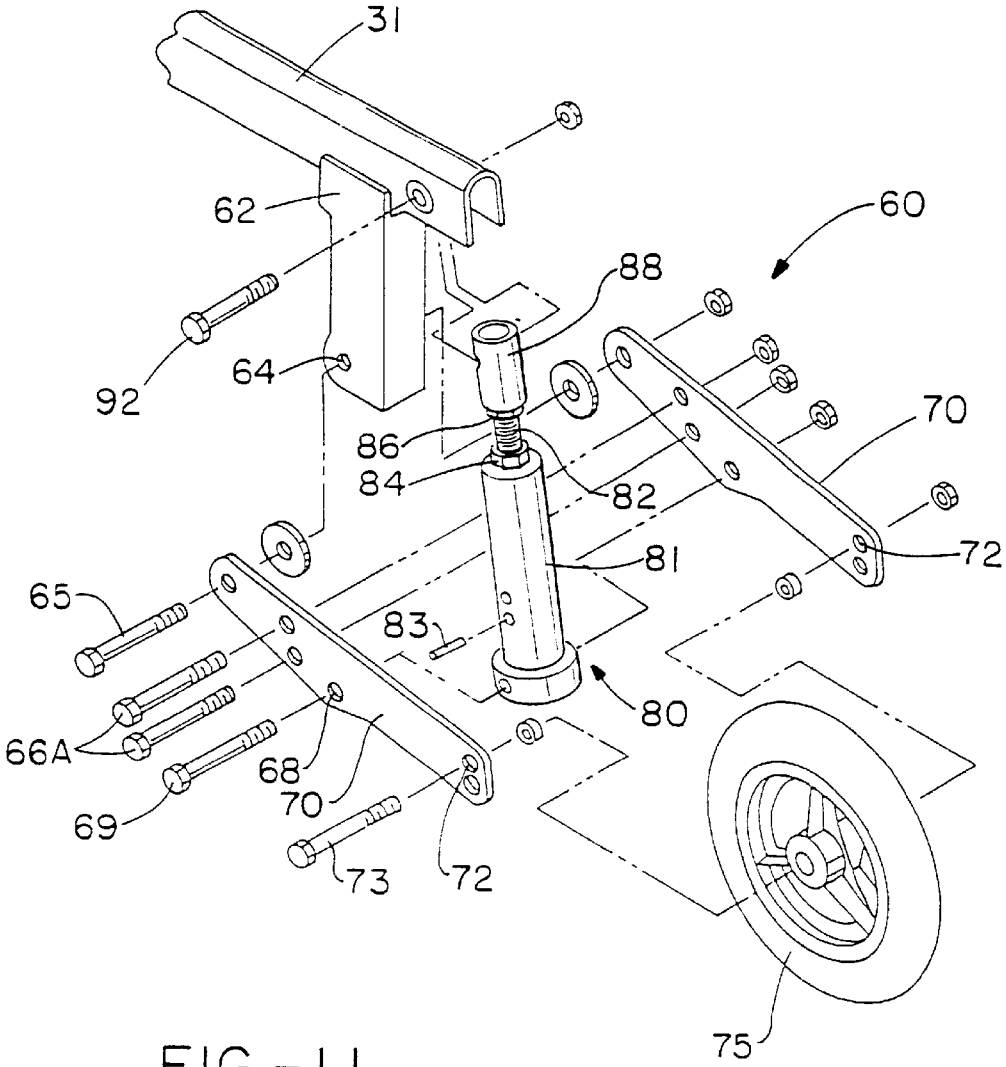
FIG. 11 is an exploded perspective view of a rigidly attached anti-tip front wheel stabilizer.
Figure 12:
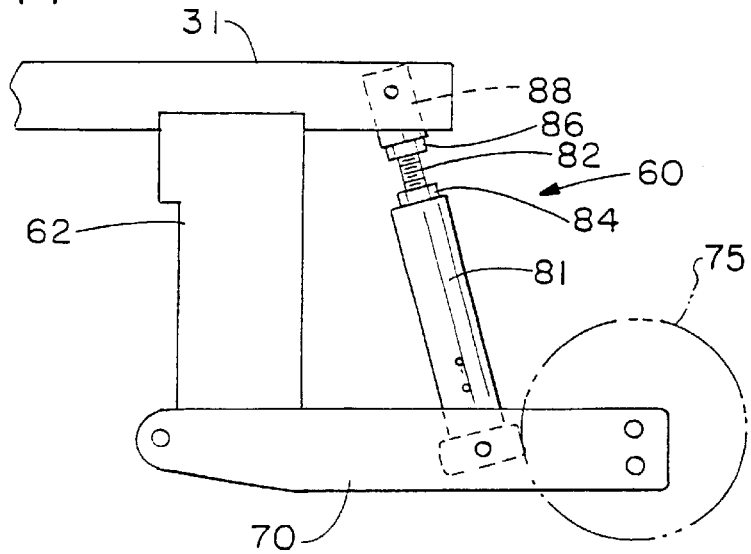
FIG. 12 is a side elevation view of FIG. 11 showing the stabilizer attached to the frame of a wheelchair.

FIGS. 11 and 12 relate to a rigidly connected anti-tip front wheel stabilizer assembly connected to a wheelchair, the suspension of which is a rigid connection to a frame similar to that shown in FIGS. 6–10. Side frame 31 has a pendant U-shaped plate 62, which at the bottom portion thereof has aperture 64 for receiving a pivot bolt 65 therethrough. Link 70 extends forwardly from plate 62 and has a plurality of spacer bolts 66A therein and spacers 66B for aligning and laterally locating link 70 with respect to one another link on the opposite sides of U-shaped plate 62. Link 70 also contains link strut aperture 68 which receives pivot bolt 69 which extends through the bottom portion of strut 80 and supports the same. Link aperture 68 is generally located between the front and rear portions of the link as in the middle thereof. The forward portion or end of link 70 can contain one or more apertures 72 for receiving an axle or pivot bolt 73 which rotatably supports anti-tip wheel 75 thereon.

Wheel 75 is rigidly or fixedly connected to the frame or side frame of a wheelchair through adjustable height strut 80. The strut comprises an elongated cylinder support 81 which receives adjusting rod 82 therein. Rod 82 can be connected to cylinder 81 through pin 83A at a plurality of locations through cylinder apertures 83B. Lock nut 84 is located near the upper portion of the rod but at a distance from the end thereof. Sleeve 88 is pivotally attached to an aperture in the frame or side frame in any convenient manner such as through the utilization of pin or pivot bolt 92. Sleeve 88 has an aperture therein for pivotally engaging pin 92. The upper portion of rod 82 has threads thereon and is threaded into corresponding threads of sleeve 88. The lower bottom portion of the sleeve contains jam nut 86, which is fixedly or securely attached thereto. Upon rotation of rod 82, support cylinder 81 can be raised or lowered thereby raising or lowering wheel 75 to any desired or predetermining height with respect to a travel surface such as a floor, sidewalk, driveway, ground, and the like. Accordingly, wheel 75 is fixedly secured by front wheel anti-tip stabilizer assembly 60 to the frame of a wheelchair, and thus moves in unison therewith. Thus, elevated anti-tip wheel 75, upon encountering an elevated obstacle such as a bump, stair, or the like, will ride over the obstacle and cause the frame of the wheelchair to rise. Also, upon a sudden stop of the wheelchair causing it to tilt forward, rigidly attached wheel 75 will strike the travel surface and prevent the wheelchair from tipping any further forward and hence from tipping over.

Figure 13:
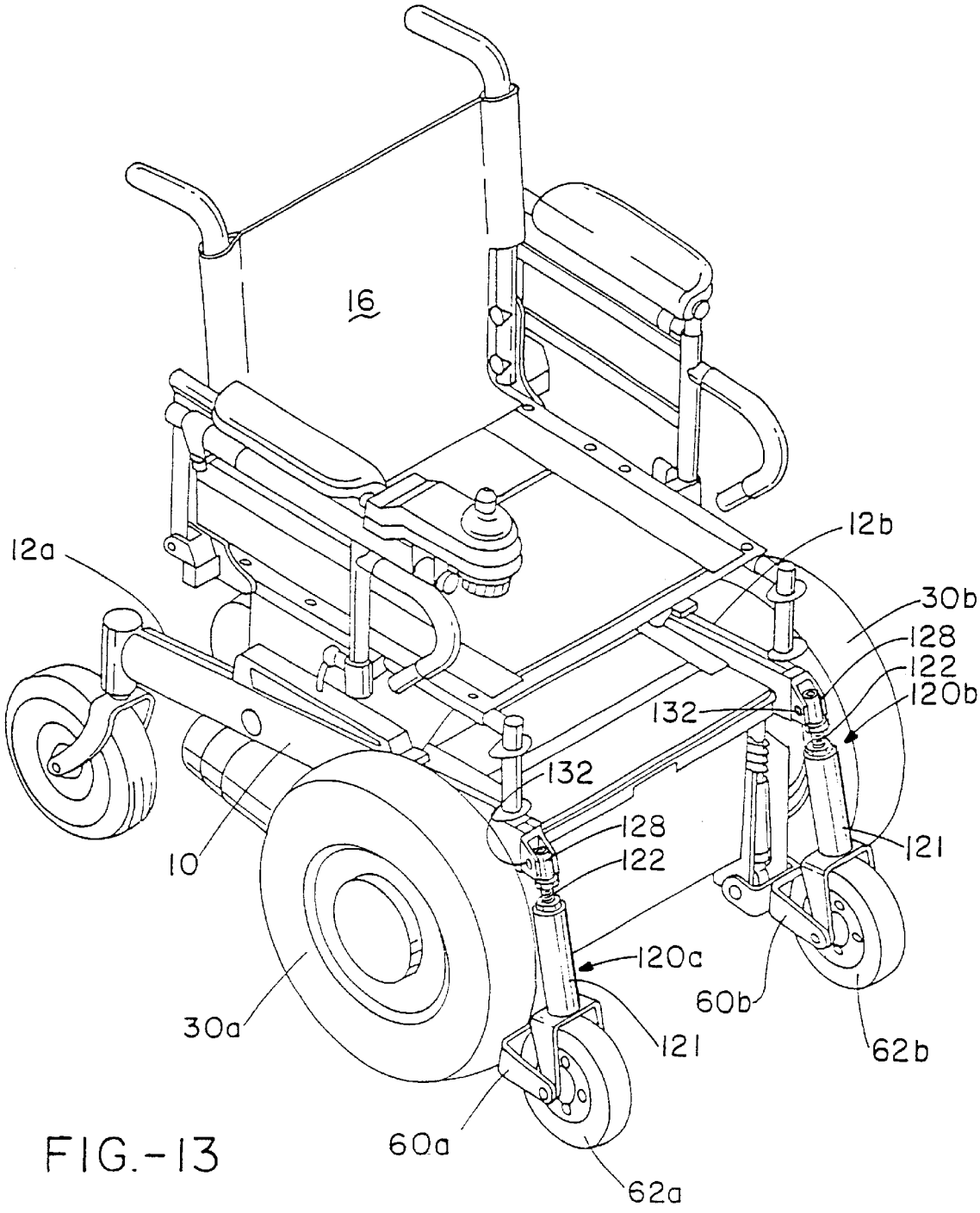
FIG. 13 is a perspective view of a mid-wheel drive wheelchair wherein the drive wheels are resiliently attached to the wheelchair frame and having anti-tip front wheel stabilizers which are rigidly connected to the frame.
Figure 15:
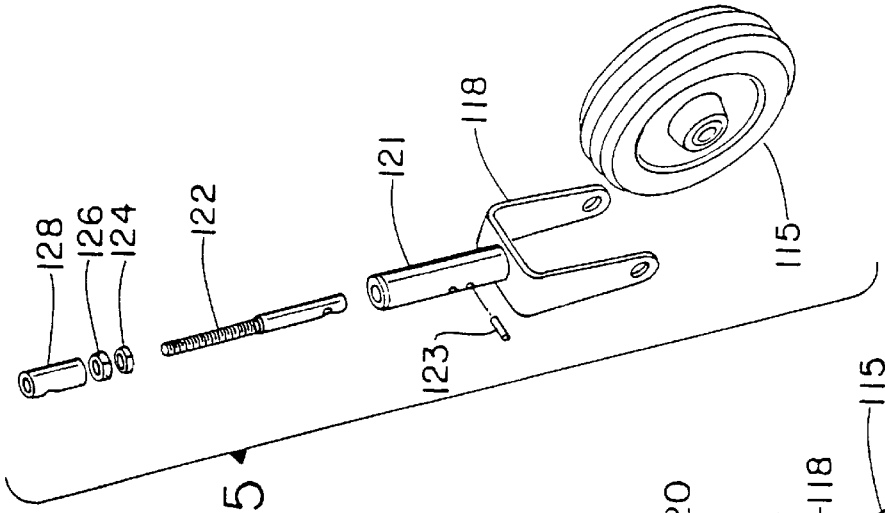
FIG. 15 is an exploded view of the anti-tip stabilizer of FIG. 14.
Figure 14:
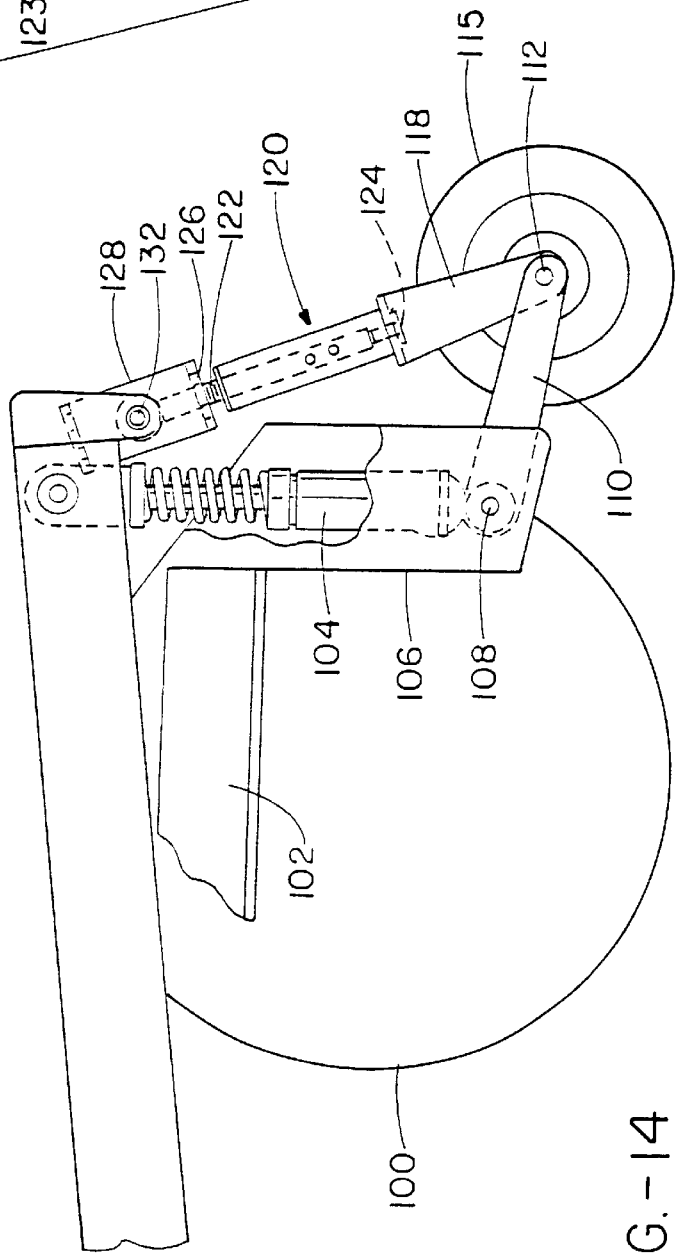
FIG. 14 is a fragmentary side elevation view of the wheelchair of FIG. 13 showing the rigidly attached anti-tip stabilizer in greater detail.

FIGS. 13 through 15 relate to a wheelchair in which the middle drive wheel is resiliently mounted via a suspension mechanism to the frame unlike the rigid or direct connection drive wheel structure of the embodiment shown in FIG. 11. The wheelchair has a mid-wheel drive wheel such as 30*a* and 30*b* in FIG. 13, and 100 in FIG. 14, which is rotatably connected to swing arm 10 having a rear portion 12*a* and a front portion 12*b* as shown in FIG. 13, and 102 as shown in FIG. 14, which in turn is resiliently mounted at a forward end thereof, by a resilient assembly such as a shock absorber spring 104, to the wheelchair frame. One end of resilient assembly 104 is attached to the frame and the other end via shock absorber pin 108 is attached to the bottom portion of swing arm bracket 106. Link 110 extends forward from swing arm bracket 106 as from pin 108 to anti-tip front wheel 62*a* and 62*b* of FIG. 13 and 115 in FIGS. 14 and 15. The link can be two separate links positioned on either lateral side of the wheel or a single "H" shaped link such as 60A, 60B as shown in FIG. 13.

The above paragraph differs from the original paragraph as indicated hereinbelow:

FIGS. 13 through 15 relate to a wheelchair in which the middle drive wheel is resiliently mounted via a suspension mechanism to the frame unlike the rigid or direct connection drive wheel structure of the embodiment shown in FIG.11. The wheelchair has a mid-wheel drive wheel such as 30*a* and 30*b* in FIG. 13, and 100 in FIG. 14, which is rotatably connected to swing arm 10 having a rear portion 12*a* and a front portion 12*b* as shown in FIG. 13, and 102 as shown in FIG. 14, which in turn is resiliently mounted at a forward end thereof, by a resilient assembly such as a shock absorber spring 104, to the wheelchair frame. One end of resilient assembly 104 is attached to the frame and the other end via shock absorber pin 108 is attached to the bottom portion of swing arm bracket 106. Link 110 extends forward from swing arm bracket 106 as from pin 108 to anti-tip front wheel 62*a* and 62*b* of FIG. 13 and 115 in FIGS. 14 and 15. The link can be two separate links positioned on either lateral side of the wheel or a single "H" shaped link such as 60A, 60B as shown in FIG. 13. The forward portion of link 110 is pivotally connected to strut 120 through pin 112 or other securing, pivoting element.

Strut 120 is similar to the strut of the embodiment shown in FIGS. 11 and 12 except that it has a lower front-wheel bracket 118 as best shown in FIG. 15. Cylindrical support 121 is connected to the top of front-wheel bracket 118 and contains rod 122 therein, the upper portion of which is threaded. Pin 123 secures the lower portion of rod 122 to cylinder support 120 at a plurality of positions. Lock nut 124 is positioned on the upper threaded portion of rod 122. Sleeve 128, which is pivotally attached via pin 132 to wheelchair frame 31, connects sleeve 128 to rod 122 via threaded jam nut 126 which is securely fastened to the bottom portion of the sleeve. The height of anti-tip wheel 115 above the travel surface can be adjusted by turning the threaded rod within jam nut 126 thereby raising or lowering the front wheel to a desired or height.

In operation, rigidly attached anti-tip front wheel 115 upon encountering an elevated obstacle such as a hill will not move but rather impart the force to the wheelchair frame to stabilize the wheelchair. Inasmuch as mid-wheel-drive wheel 100 is resiliently attached to the frame, upon encountering an obstacle such as a bump, hill, or a depression, it will move upward or downward. Since strut 120 prevents front anti-tip wheel 115 from moving, link 110 will pivot about pins 112 and 108 thereby compensating for the movement of the shock absorber. Should the wheelchair stop too quickly, anti-tip front wheel 115 will prevent the wheelchair from tipping over by contacting the travel surface and resisting further forward rotational movement of the wheelchair.

While a specific structure of the rigid attachment between the front anti-tip wheel shown in FIGS. 12 through 15 has been described, it is to be understood that other rigid assemblies can also be utilized.

While in accordance with the patent statutes the best mode and preferred embodiment has been set forth, the scope of the invention is not limited thereto, but rather by the scope of the attached claims.

What is claimed is:

1. A mid-wheel drive wheelchair, comprising:

a frame, a pair of drive wheels rotatably attached to said frame, at least one wheel located rearwardly of said drive wheels and operatively and rotatably attached to said frame, at least one rotatable front anti-tip wheel located forward of said drive wheels and located at a height above a drive surface, said front anti-tip wheel rigidly attached to said frame operatively through a strut which prevents said rotatable front anti-tip wheel from moving resiliently during operation of said wheelchair, and a link, a forward portion of said link operatively connected to a bottom portion of said strut, and a rearward portion of said link operatively connected to a different portion of said wheel chair frame than said strut connection portion.

2. A mid-wheel drive wheelchair according to claim 1, wherein the height of said rigidly fixed anti-tip wheel above a surface is adjustable.

3. A mid-wheel drive wheelchair according to claim 2, wherein one portion of said strut is operatively connected to said wheelchair frame and another portion of said strut is operatively connected to said anti-tip wheel.

4. A mid-wheel drive wheelchair according to claim 3, wherein said strut comprises a cylinder, a sleeve, and a rod adjustably connected to both said sleeve and said cylinder so that said height of said anti-tip wheel above a drive surface can be adjusted.

5. A mid-wheel drive wheelchair according to claim 4, wherein said strut cylinder is connected to a forward portion of the link, wherein said link is connected at the rearward portion thereof to a member extending from said frame, wherein said sleeve is connected to a side frame member of said frame, and wherein said rotatable front anti-tip wheel is connected to said link forward portion in front of said strut cylinder.

6. A mid-wheel drive wheelchair, comprising:

a frame, a pair of mid-wheels, each wheel independently driven by a motor, at least one wheel located rearwardly of said mid-wheel drive wheels, at least one rotatable anti-tip front wheel, said anti-tip wheel rigidly attached to said frame, and a strut, one end of said strut fixedly attached to said front anti-tip wheel and the other end of said strut fixedly attached to said frame so that said rotatable anti-tip wheel is rigidly attached to said wheelchair and prevented from moving resiliently during operation of said wheelchair, and wherein said strut is connected to a forward portion of a link, wherein said link is connected at a rearward portion thereof to a member extending from said frame, wherein said strut is connected to a side frame member of said frame, and wherein said rotatable front anti-tip wheel is connected to said link forward portion in front of said strut.

7. A mid-wheel drive wheelchair according to claim 6, wherein said anti-tip wheel is located a predetermined height above a drive surface.

8. A mid-wheel drive wheelchair according to claim 7, wherein said strut comprises a height adjustable element so that said anti-tip wheel can be located at said predetermined height above said drive surface.

9. A mid-wheel drive wheelchair according to claim 8, wherein said height adjustable element is an adjustable rod.

10. A mid-wheel drive wheelchair according to claim 7, wherein said strut comprises a sleeve operatively connected to said frame, a cylinder operatively connected to said anti-tip wheel, and an intermediate rod, said rod operatively and height adjustably connected to said sleeve, to said cylinder, or to both.

11. A mid-wheel drive wheelchair according to claim 10, wherein said height adjustable element is an adjustable rod.

* * * * *